US006941846B2

(12) United States Patent
Hsien

(10) Patent No.: US 6,941,846 B2
(45) Date of Patent: Sep. 13, 2005

(54) PLIERS

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/436,418

(22) Filed: May 8, 2003

(65) Prior Publication Data

US 2004/0221695 A1 Nov. 11, 2004

(51) Int. Cl.[7] ..... B25B 7/02
(52) U.S. Cl. ..... 81/427.5; 81/415; 81/489
(58) Field of Search ..... 81/427.5, 415, 81/489, 416, 381–383, 300, 342; D8/4, 51, 52, 107

(56) References Cited

U.S. PATENT DOCUMENTS

| | | | | | |
|---|---|---|---|---|---|
| 1,442,486 | A | * | 1/1923 | Looke | 72/409.19 |
| 1,684,775 | A | * | 9/1928 | Neikirk | 81/326 |
| 2,458,725 | A | * | 1/1949 | Periman | 81/341 |
| D222,689 | S | * | 12/1971 | Futami | D8/4 |
| 3,675,359 | A | * | 7/1972 | Ohno | 43/53.5 |
| D258,411 | S | * | 3/1981 | Futami | D8/4 |
| 4,829,858 | A | * | 5/1989 | Kern et al. | 81/415 |
| 4,934,222 | A | * | 6/1990 | Rittmann et al. | 81/427.5 |
| D368,212 | S | * | 3/1996 | Johnston | D8/52 |
| D369,534 | S | * | 5/1996 | Liou | D8/52 |
| 5,893,303 | A | * | 4/1999 | Harris | 81/44 |
| 6,024,000 | A | * | 2/2000 | Goldmann, II | 81/427.5 |
| 6,134,994 | A | * | 10/2000 | Gomas | 81/427.5 |
| 6,145,417 | A | * | 11/2000 | Bates et al. | 81/387 |
| D445,319 | S | * | 7/2001 | Choi | D8/4 |
| 6,270,134 | B1 | * | 8/2001 | Lin | 294/16 |
| 6,282,995 | B1 | * | 9/2001 | Lin | 81/423 |
| 6,370,992 | B1 | * | 4/2002 | Shih-Kuei | 81/427.5 |
| 6,408,725 | B1 | * | 6/2002 | Janson | 81/407 |
| D472,127 | S | * | 3/2003 | Willinger et al. | D8/107 |
| 6,532,847 | B2 | * | 3/2003 | Liou | 81/416 |
| D479,789 | S | * | 9/2003 | Brantley | D8/107 |

FOREIGN PATENT DOCUMENTS

| | | | | |
|---|---|---|---|---|
| EP | 130241 A1 | * | 1/1985 | B25B/7/00 |
| FR | 2618714 A3 | * | 2/1989 | B25B/7/00 |

* cited by examiner

*Primary Examiner*—David B. Thomas

(57) ABSTRACT

A pair of pliers include two pivot members pivotally connected with each other. Each of the two pivot members has an end formed with a handle including an upper auxiliary body and a lower auxiliary body to enhance a hand-held area of the handle, thereby facilitating a user' hand holding the handle. In addition, the handle of each of the two pivot members has an upper auxiliary body and a lower auxiliary body to provide a better holding effect to the user, so that the user has a comfortable sensation when holding the handle.

1 Claim, 9 Drawing Sheets

PLIERS

BACKGROUND OF THE INVENTION

1. Field of the Invention

The present invention relates to a pair of pliers, and more particularly to a pair of pliers having an anti-slip effect.

2. Description of the Related Art

A pair of conventional pliers in accordance with the prior art shown in FIG. 11 comprises two pivot members 30 pivotally connected with each other by a pivot axle 33. Each of the two pivot members 30 has a first end formed with a jaw 31 and a second end formed with a handle 34. In such a manner, the pliers can be used to remove a workpiece (such as a nail) from an article (such as a wooden piece).

However, the handle 34 of each of the two pivot members 30 has a smaller hand-held area, thereby easily causing inconvenience to the user hand when holding the handle. In addition, the handle 34 of each of the two pivot members 30 has a uniform diameter, so that the user has an uncomfortable sensation when holding the handle.

SUMMARY OF THE INVENTION

The primary objective of the present invention is to provide a pair of pliers, wherein when the pliers slip forward unintentionally, the protrusion of the handle of each of the two pivot members can provide a stop effect so as to protect the user's hand.

Another objective of the present invention is to provide a pair of pliers, wherein the resting portion of the handle of each of the two pivot members can efficiently provide an anti-slip effect to the user's hand, thereby preventing the user's hand from slipping from the pliers.

A further objective of the present invention is to provide a pair of pliers, wherein the handle of each of the two pivot members has an upper auxiliary body and a lower auxiliary body to enhance the hand-held area of the handle, thereby facilitating the user' hand holding the handle.

A further objective of the present invention is to provide a pair of pliers, wherein the handle of each of the two pivot members has an upper auxiliary body and a lower auxiliary body to provide a better holding effect to the user, so that the user has a comfortable sensation when holding the handle.

In accordance with the present invention, there is provided a pair of pliers, comprising:

two pivot members pivotally connected with each other;

each of the two pivot members having an end formed with a handle; and the handle of each of the two pivot members including an upper auxiliary body and a lower auxiliary body to enhance a hand-held area of the handle, thereby facilitating a user' hand holding the handle.

Further benefits and advantages of the present invention will become apparent after a careful reading of the detailed description with appropriate reference to the accompanying drawings.

DETAILED DESCRIPTION OF THE INVENTION

Figure 1:
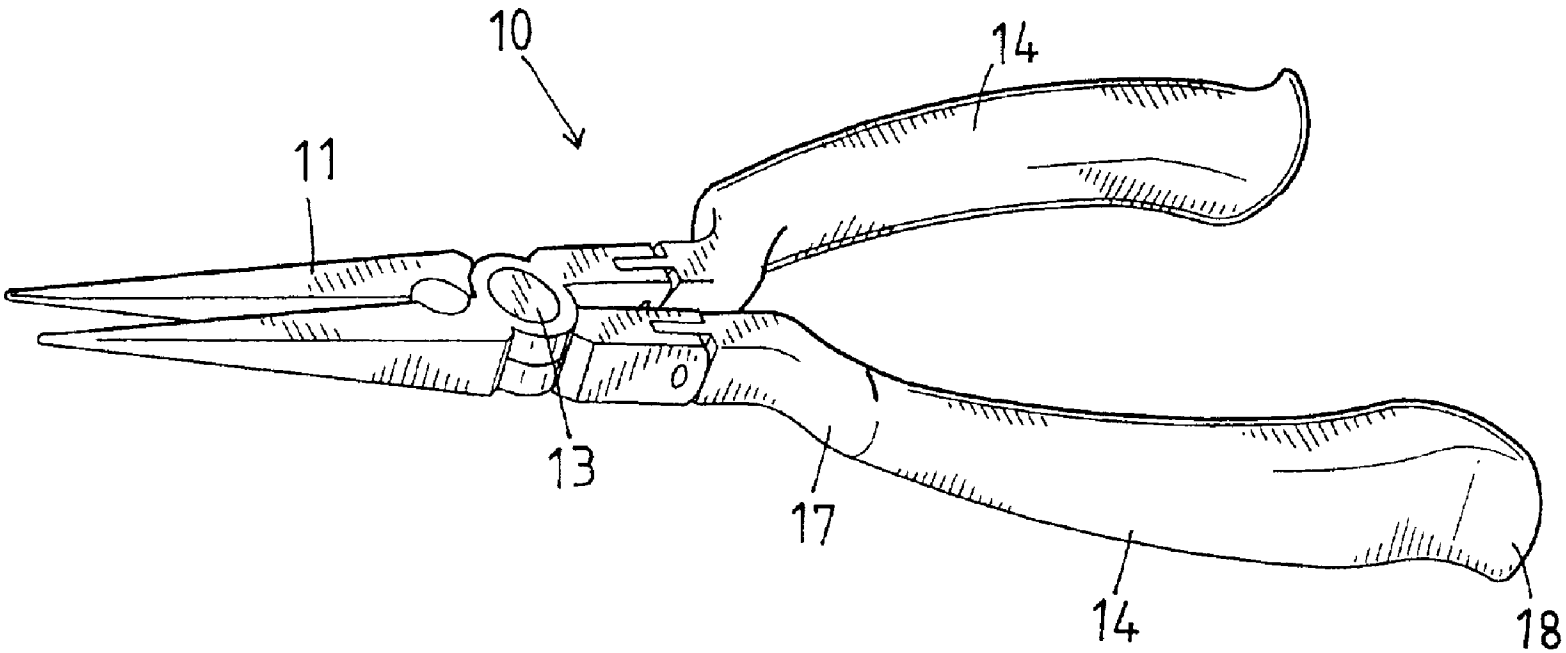
FIG. 1 is a perspective view of a pair of pliers in accordance with the preferred embodiment of the present invention.

Referring to the drawings and initially to FIGS. 1–5, a pair of pliers in accordance with the preferred embodiment of the present invention comprises two pivot members 10 pivotally connected with each other by a pivot axle 13. Each of the two pivot members 10 has a first end formed with a jaw 11 and a second end formed with a handle 14.

Figure 3:
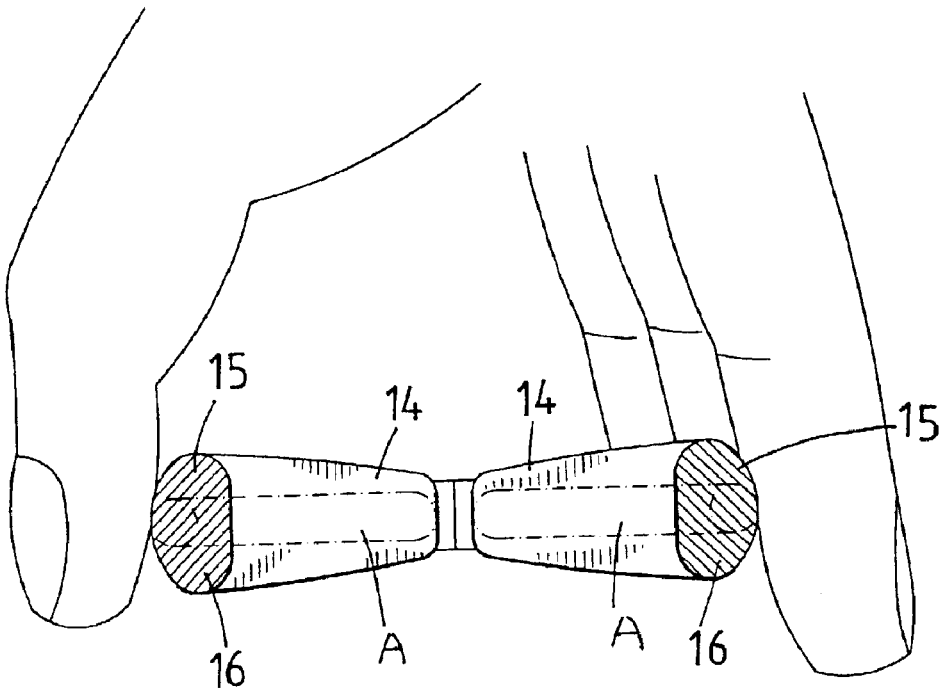
FIG. 3 is a side plan cross-sectional view of the pliers in accordance with the preferred embodiment of the present invention.

As shown in FIG. 3, the handle 14 of each of the two pivot members 10 includes a circular main body "A", an upper auxiliary body 15 extending from the main body "A", and a lower auxiliary body 16 extending from the main body "A".

Thus, the handle 14 of each of the two pivot members 10 has an upper auxiliary body 15 and a lower auxiliary body 16 to enhance the hand-held area of the handle 14, thereby facilitating the user' hand holding the handle 14. In addition, the handle 14 of each of the two pivot members 10 has an upper auxiliary body 15 and a lower auxiliary body 16 to provide a better holding effect to the user, so that the user has a comfortable sensation when holding the handle 14.

Figure 4:
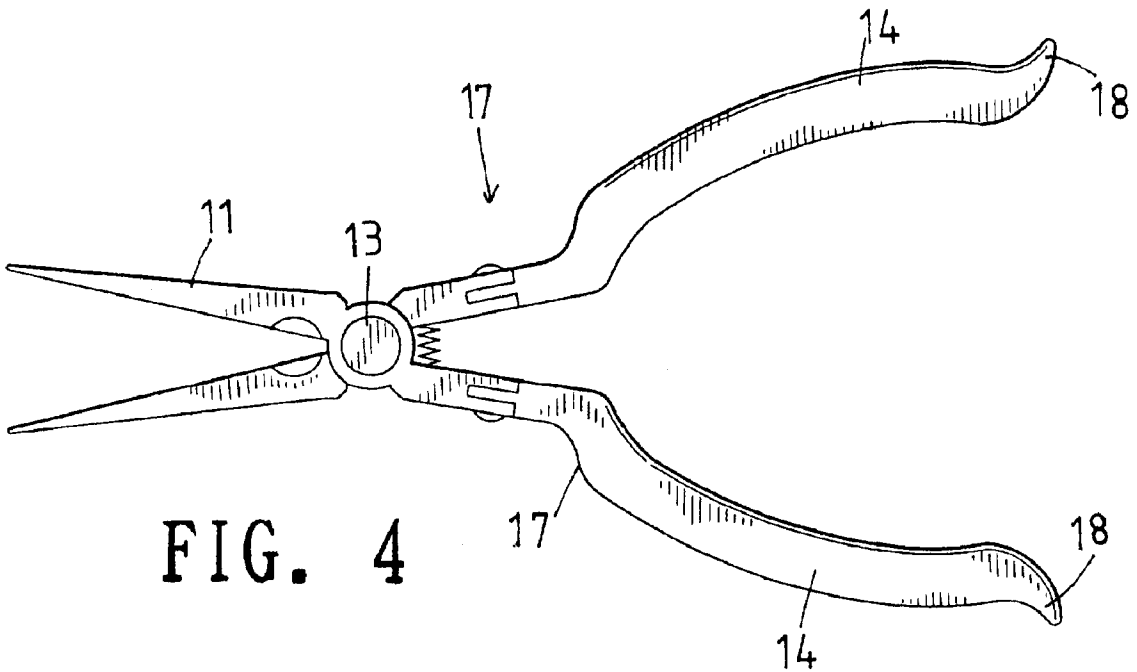
FIG. 4 is a top plan view of the pliers as shown in FIG. 1.

As shown in FIG. 4, the handle 14 of each of the two pivot members 10 has a first end integrally formed with a protrusion 17. The protrusion 17 is made of material having a greater hardness. Thus, the protrusion 17 of the handle 14 of each of the two pivot members 10 can provide a stop effect when the pliers slip forward unintentionally, so as to protect the user's hand. In addition, the handle 14 of each of the two pivot members 10 has a second end integrally formed with an arcuate concave resting portion 18 to provide a resting effect to the user's hand and to provide an anti-slip effect.

Figure 5:
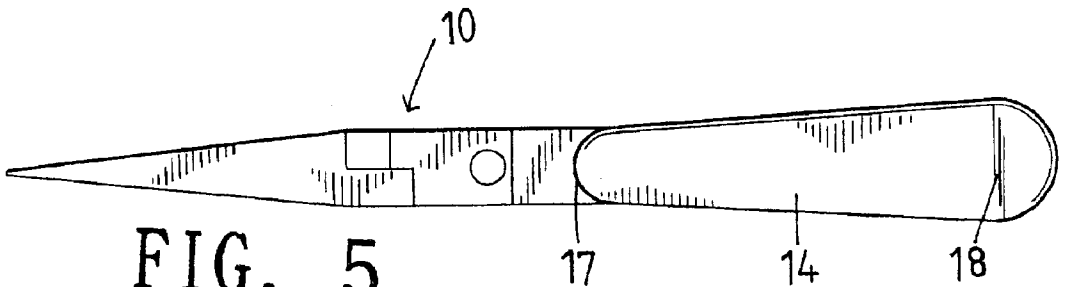
FIG. 5 is a front plan view of the pliers as shown in FIG. 1.

As shown in FIG. 5, the thickness of the handle 14 of each of the two pivot members 10 is increased from the first end to the second end of the handle 14. Thus, the handle 14 of each of the two pivot members 10 satisfies the ergonomic design, so that the user has a comfortable sensation when holding the handle 14.

Figure 2:
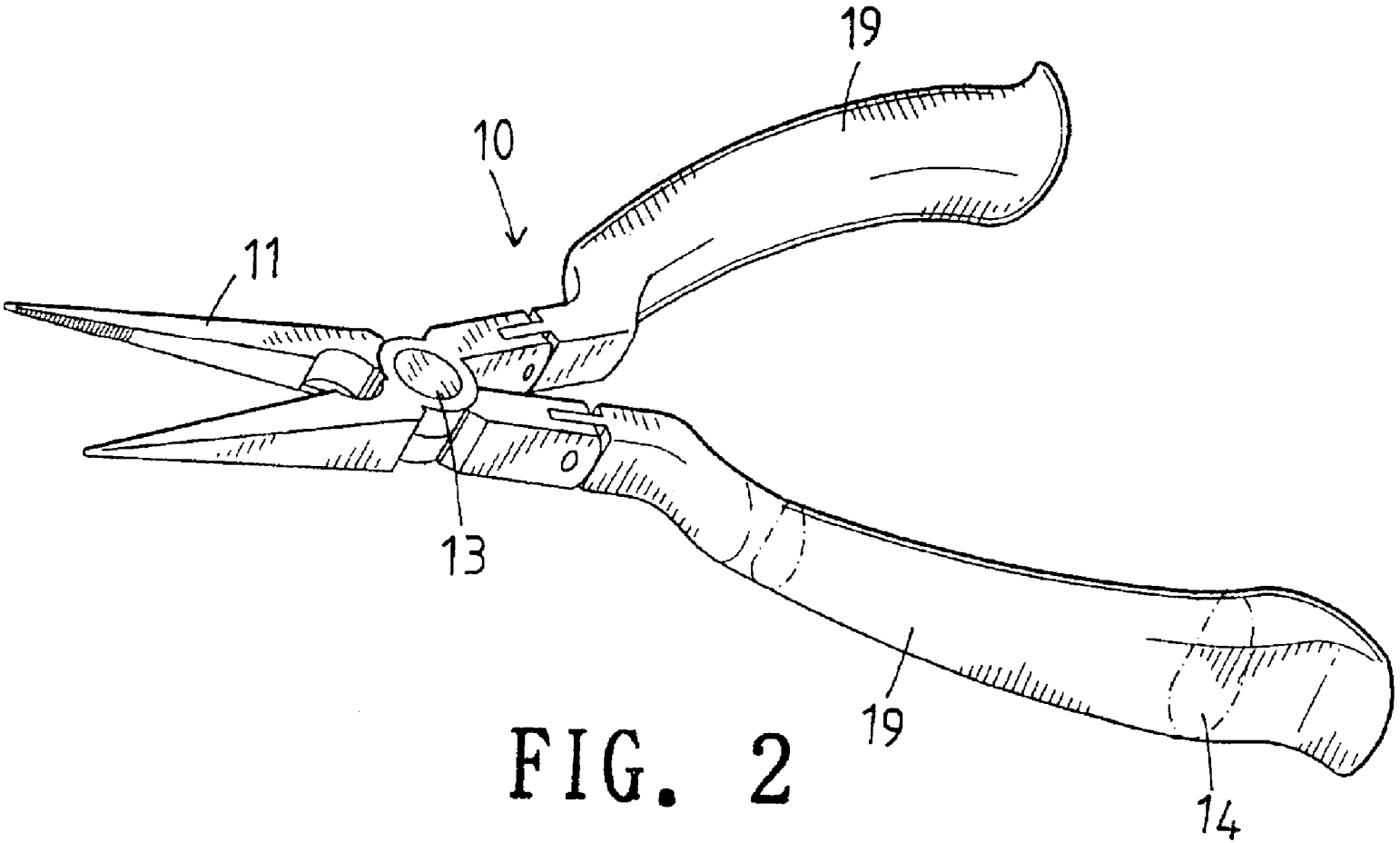
FIG. 2 is a perspective view of the pliers in accordance with the preferred embodiment of the present invention.

As shown in FIG. 2, the handle 14 of each of the two pivot members 10 is provided with a protective jacket 19 made of softer material, so that the user has a comfortable sensation when holding the handle 14.

Figure 6:
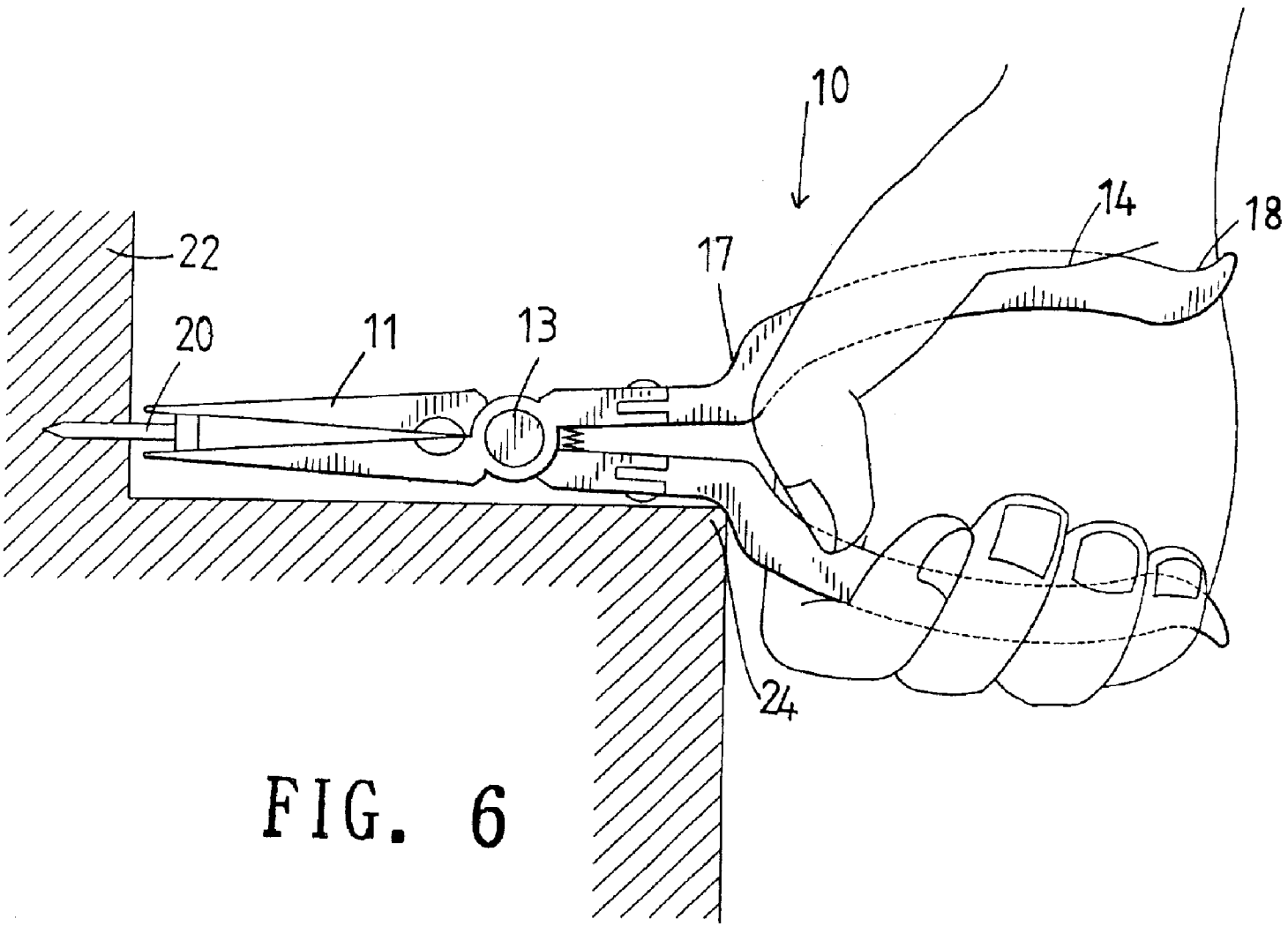
FIG. 6 is a schematic plan operational view of the pliers as shown in FIG. 1 in use.

In operation, referring to FIG. 6 with reference to FIGS. 1–5, the pliers can be used to remove a workpiece 20 (such as a nail) from an article 22 (such as a wooden piece). When the jaws 11 of the two pivot members 10 slip on the workpiece 20 to cause the pliers to slip forward unintentionally, the protrusion 17 of the handle 14 of each of the two pivot members 10 is rested on the corner 24 of the article 22 to provide a stop effect so as to protect the user's hand. In addition, the resting portion 18 of the handle 14 of each of the two pivot members 10 can efficiently provide a resting and anti-slip effect to the user's hand, thereby preventing the user's hand from slipping from the pliers. Further, the handle 14 of each of the two pivot members 10 has an upper auxiliary body 15 and a lower auxiliary body 16 to enhance the hand-held area of the handle 14, thereby facilitating the user' hand holding the handle 14.

Figure 7:
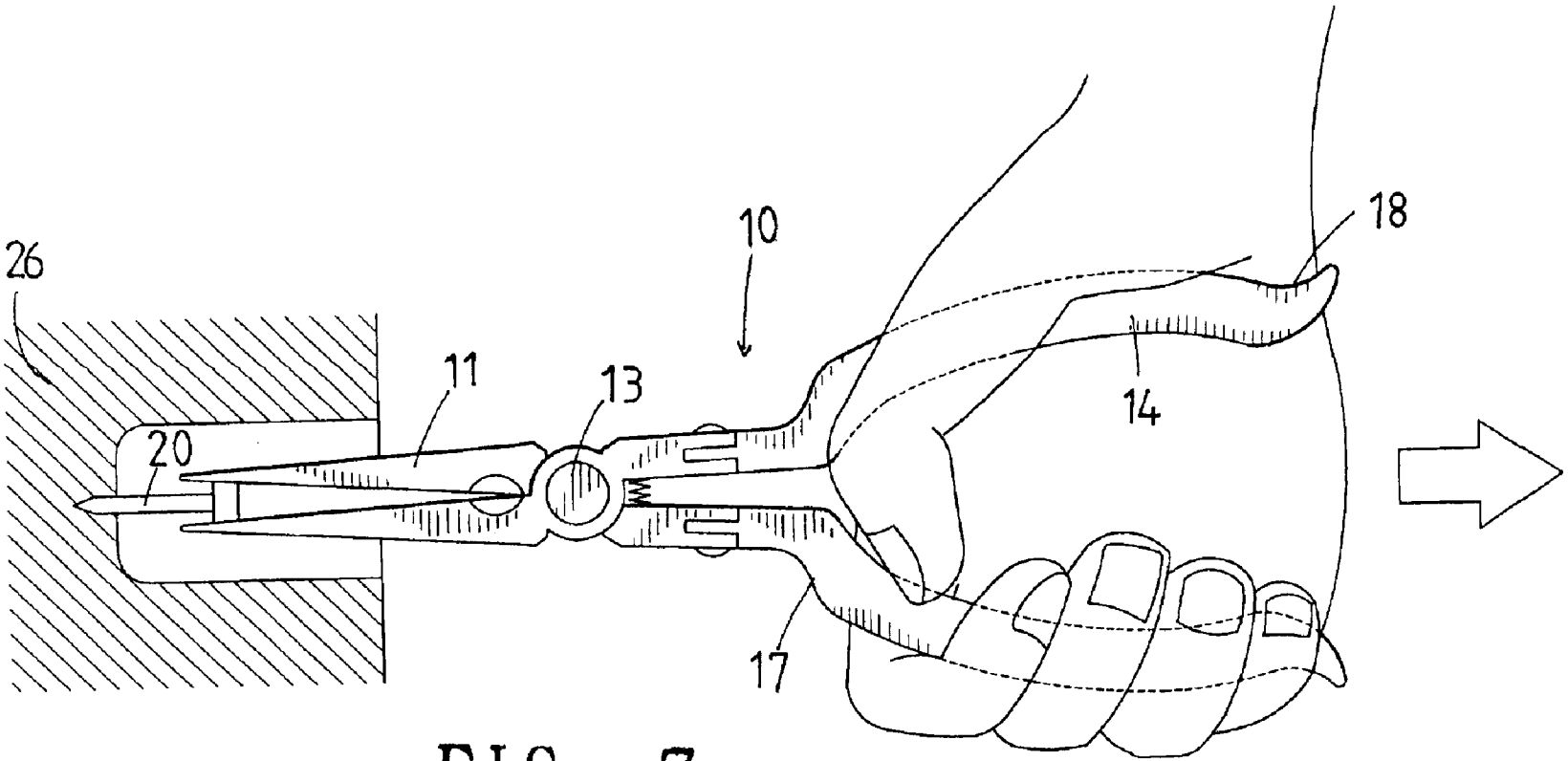
FIG. 7 is a schematic plan operational view of the pliers as shown in FIG. 1 in use.

Referring to FIG. 7, the pliers can be used to remove the workpiece 20 from an article 26.

Figure 8:
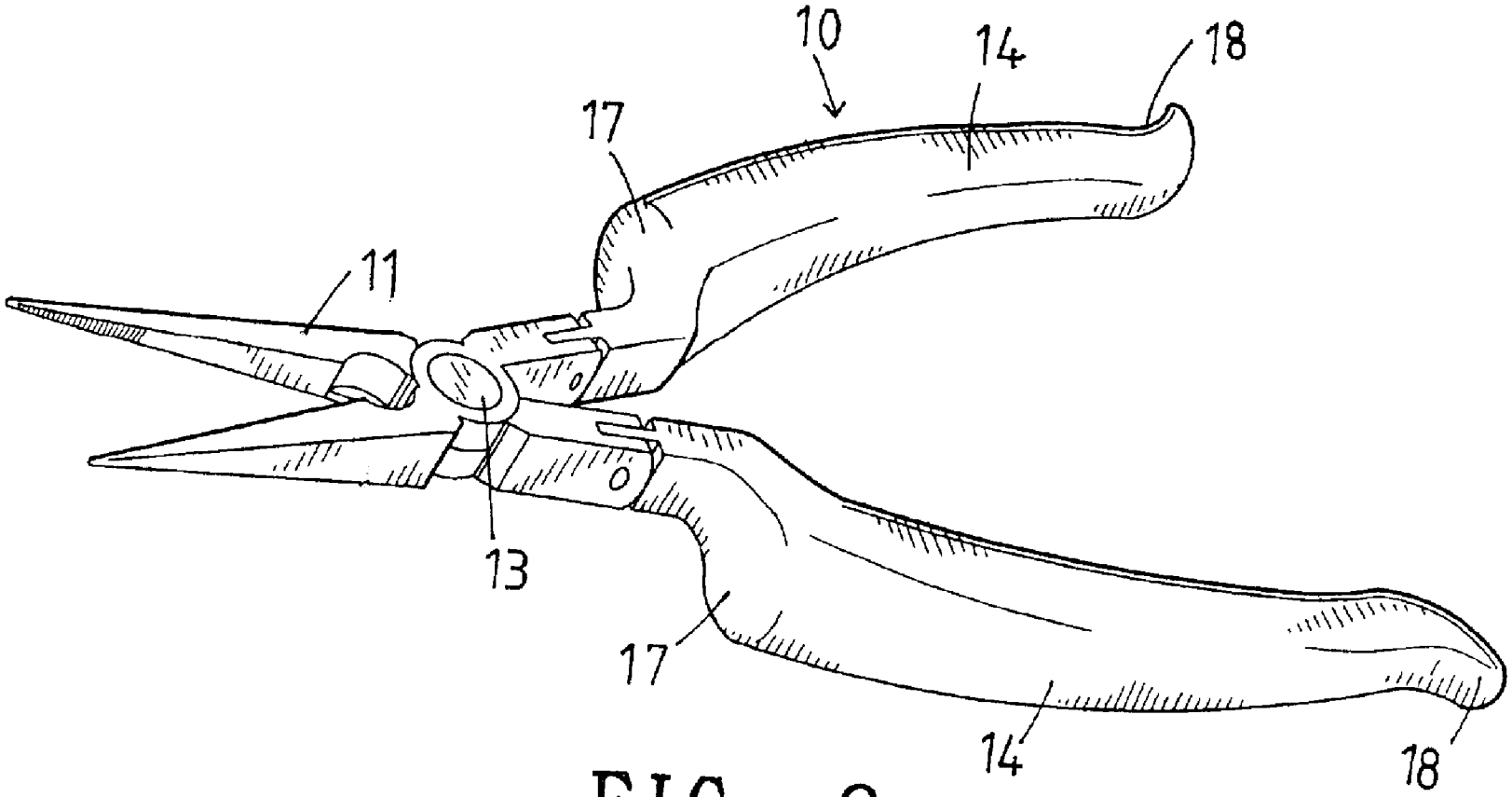
FIG. 8 is a perspective view of a pair of pliers in accordance with another embodiment of the present invention.
Figure 9:
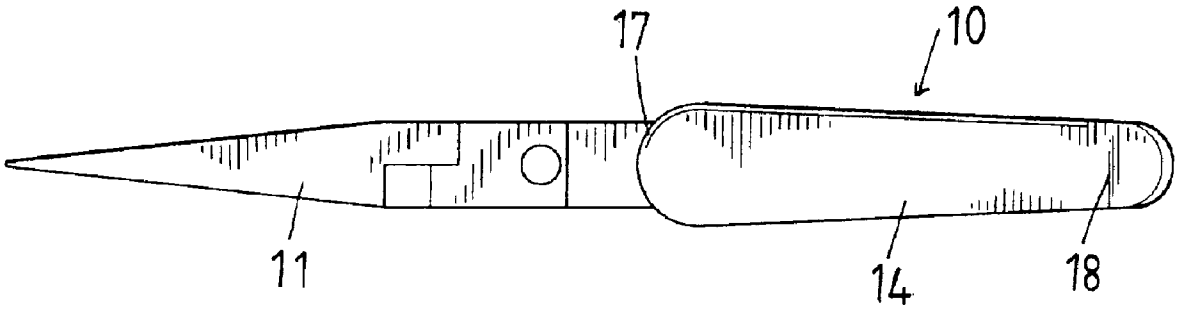
FIG. 9 is a front plan view of the pliers as shown in FIG. 8.
Figure 10:
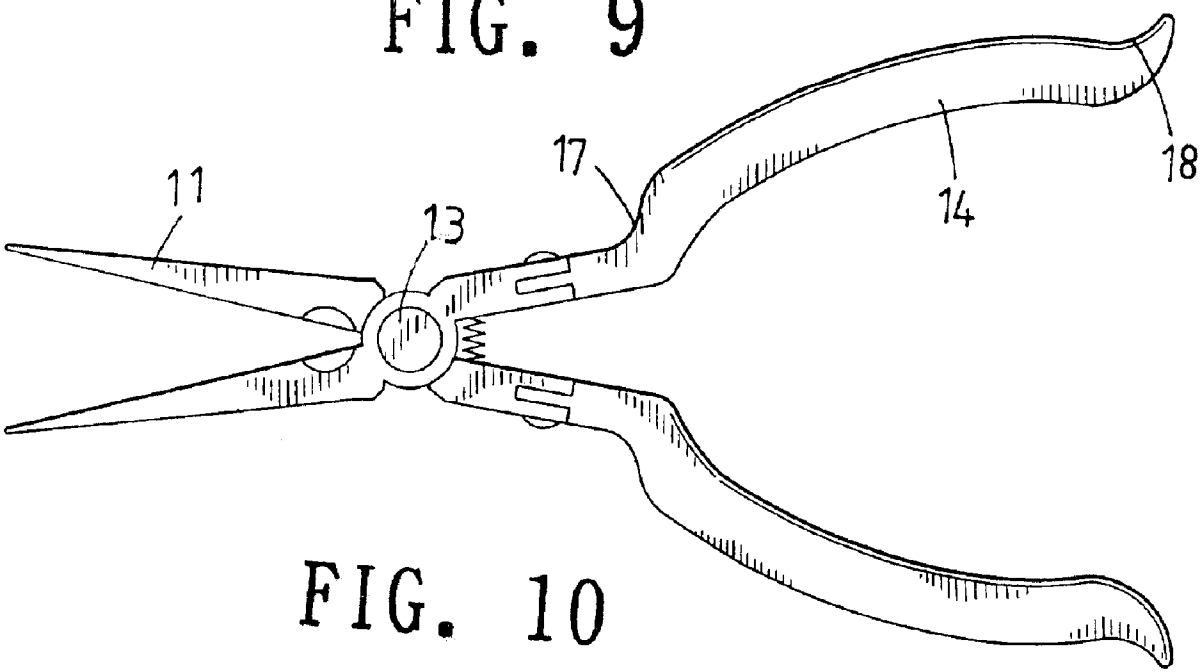
FIG. 10 is a top plan view of the pliers as shown in FIG. 8.
Figure 11:
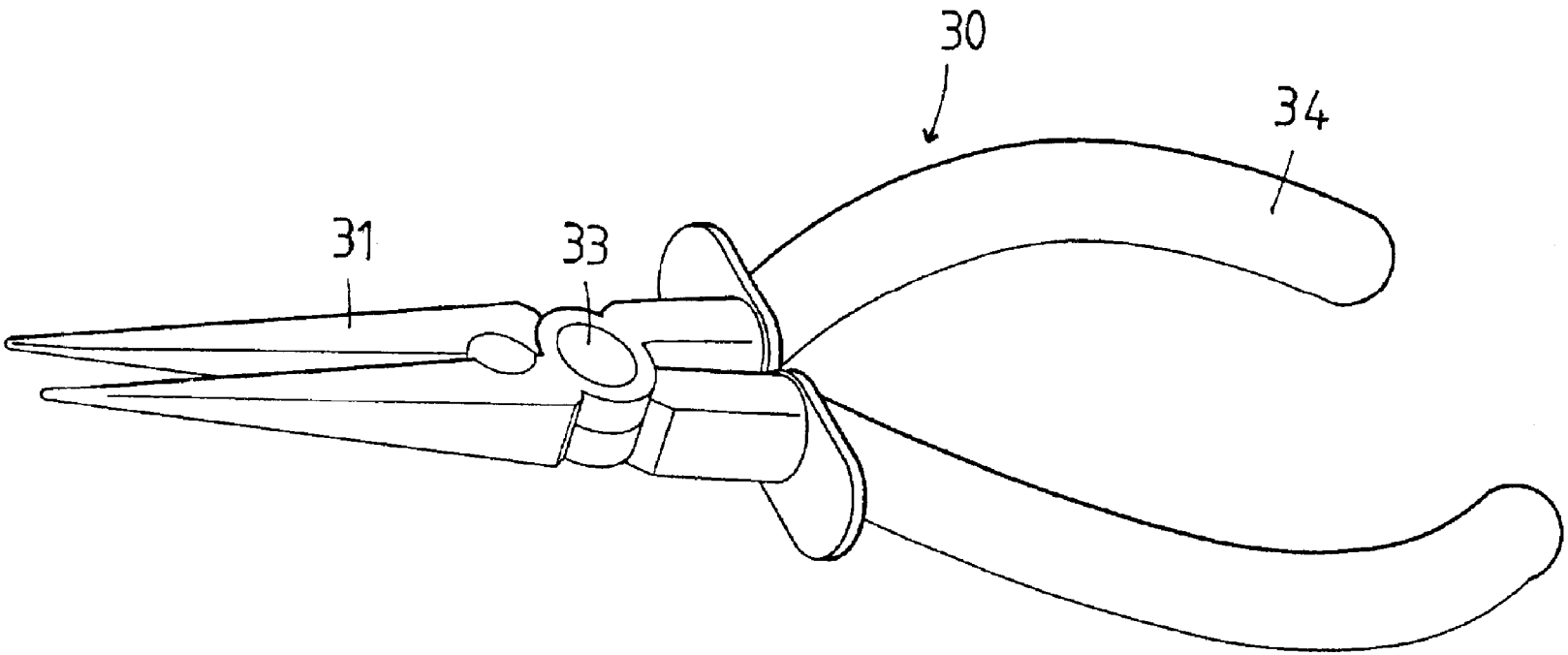
FIG. 11 PRIOR ART
FIG. 11 is a perspective view of a pair of conventional pliers in accordance with the prior art.

Referring to FIGS. 8–10, the pliers in accordance with another embodiment of the present invention is shown, wherein the thickness of the handle 14 of each of the two pivot members 10 is decreased from the first end to the second end of the handle 14. Thus, the handle 14 of each of the two pivot members 10 satisfies the ergonomic design, so that the user has a comfortable sensation when holding the handle 14.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pair of pliers, comprising:

two pivot members pivotally connected with each other;

each of the two pivot members having an end formed with a handle;

the handle of each of the two pivot members including an upper auxiliary body and a lower auxiliary body to enhance a hand-held area of the handle thereby facilitating a user's handle holding the handle;

wherein the handle of each of the two pivot members includes a circular main body, the upper auxiliary body extends from the main body, and the lower auxiliary body extends from the main body;

wherein handle of each of the two pivot members has a first end integrally formed with a protrusion; and the protrusion is made of a hard material;

wherein the handle of each of the two pivot members has a second end integrally formed with an arcuate concave resting portion;

wherein the handle of each of the two pivot members is provided with a protective jacket; and wherein the handle of each of the two pivot members has the first end and the second end, and the first end being proximal to the pivot members; and the second end being distal to the pivot members; the thickness of the handle of each of the two pivot members is increased from the first end to the second end of the handle; and thus each handle has one end thicker than the other end of the handle.

* * * * *